US009651225B2

(12) United States Patent
Purdy

(10) Patent No.: US 9,651,225 B2
(45) Date of Patent: May 16, 2017

(54) VARIOUS SIZE LED LINEAR LAMPS AND EASY SHIPPING WITH SNAP FIT CONNECTION

(71) Applicant: ELB ELECTRONICS, INC., Arcadia, CA (US)

(72) Inventor: Steven Purdy, Johns Creek, GA (US)

(73) Assignee: ELB ELECTRONICS, INC., Arcadia, CA (US)

( * ) Notice: Subject to any disclaimer, the term of this patent is extended or adjusted under 35 U.S.C. 154(b) by 150 days.

(21) Appl. No.: 14/728,208

(22) Filed: Jun. 2, 2015

(65) Prior Publication Data

US 2015/0345755 A1 Dec. 3, 2015

Related U.S. Application Data

(60) Provisional application No. 62/006,417, filed on Jun. 2, 2014.

(51) Int. Cl.

| | |
|---|---|
| ***F21S 4/00*** | (2016.01) |
| ***F21V 17/16*** | (2006.01) |
| ***F21V 17/00*** | (2006.01) |
| ***F21K 9/27*** | (2016.01) |
| *F21V 23/06* | (2006.01) |
| *F21Y 101/00* | (2016.01) |
| *F21Y 103/10* | (2016.01) |
| *F21Y 115/10* | (2016.01) |
| *F21Y 103/37* | (2016.01) |

(52) U.S. Cl.
CPC ..... *F21V 17/16* (2013.01); *F21K 9/27* (2016.08); *F21V 17/007* (2013.01); *F21V 23/06* (2013.01); *F21Y 2101/00* (2013.01); *F21Y 2103/10* (2016.08); *F21Y 2103/37* (2016.08); *F21Y 2115/10* (2016.08)

(58) Field of Classification Search
CPC ..... F21V 17/16; F21V 17/007; F21V 23/06; F21K 9/27; F21Y 2103/37; F21Y 2103/10; F21Y 2115/10; F21Y 2101/00
USPC ..... 362/219, 217.01, 398
See application file for complete search history.

(56) References Cited

U.S. PATENT DOCUMENTS 5,559,681 A * 9/1996 Duarte ..... F21V 21/08 362/231
2006/0049368 A1* 3/2006 Culbert ..... A61L 9/20 250/503.1

(Continued)

*Primary Examiner* — Anh Mai
*Assistant Examiner* — Glenn Zimmerman
(74) *Attorney, Agent, or Firm* — Karish & Bjorgum, PC

(57) ABSTRACT

An LED linear lamp assemblage. The assemblage has two LED linear lamp sections, each LED linear lamp section with an elongated tube with a transparent or translucent cover that connects to the base portion that defines a space inside. A circuit board with a plurality of spaced apart LEDs and electrical connectors are disposed within the space. At first ends of the two LED linear lamp sections are pin(s) for connecting to a power source, and the electrical connectors are located near second ends of each LED linear lamp section. A joiner unit is provided for mechanically connecting and holding the two LED linear lamps sections together at their second ends. When the two LED linear lamp sections are connected at their second ends to establish electrical connection the LED linear lamp assemblage is complete.

14 Claims, 16 Drawing Sheets

(56) References Cited

U.S. PATENT DOCUMENTS

| | | | | |
|---|---|---|---|---|
| 2010/0142205 | A1* | 6/2010 | Bishop | F21V 21/00 362/249.02 |
| 2012/0008315 | A1* | 1/2012 | Simon | F21V 21/005 362/217.13 |
| 2012/0275154 | A1* | 11/2012 | Hood | F21V 31/005 362/249.02 |
| 2013/0286675 | A1* | 10/2013 | Hasan | F21V 25/12 362/543 |
| 2015/0267899 | A1* | 9/2015 | Baright | F21V 15/01 362/223 |

* cited by examiner

VARIOUS SIZE LED LINEAR LAMPS AND EASY SHIPPING WITH SNAP FIT CONNECTION

CROSS-REFERENCE TO RELATED APPLICATION(S)

This application claims priority from U.S. Provisional Patent Application No. 62/006,417, entitled "VARIOUS SIZE LED LINEAR LAMPS AND EASY SHIPPING WITH SNAP FIT CONNECTION", and filed Jun. 2, 2014.

FIELD OF THE INVENTION

The invention relates to LED linear lamps, and more particularly to LED linear lamps that can be broken down into smaller component sections so that they can be stored, shipped, and handled more easily and cost effectively compared to fluorescent glass counterparts and prior art LED linear lamps.

BACKGROUND OF THE INVENTION

Straight fluorescent linear lamps are made of glass and come in various sizes such as 61.0 cm (2'), 122.0 cm (4'), and 244 cm (8') lengths. The longer the length, the more difficult they are to store, pack, ship, display, and handle without the risk of damage. For example, the popular 244 cm (8') long fluorescent lamp is not easily capable of being transported in a car and cannot be shipped in the mail or by delivery vehicles easily. When displayed in stores, these lamps are typically stood up vertically or laid horizontally on display racks. In the process of retrieving these long fluorescent lamps breakage is not uncommon. This not only results in loss of the merchandise, but extra cleanup costs are incurred as fluorescent lamps contain mercury and must be handled and disposed of with extra care.

In addition to straight fluorescent linear lamps, there are also a variety of U-bend fluorescent lamps that include two parallel leg sections with single pins or bi-pins at one end of each leg and a U-shaped section joining the two legs at their other end. The two legs are separated on center by standards increments, including 4.13 cm (1.625"), 7.62 cm (3"), and 15.2 cm (6"). The straight sections also come in various lengths and the tube diameters are also available in a variety of sizes. On top of this, U-bend fluorescent lamps are provided in different wattages/lumen output and also different Kelvin temperatures, e.g., 2700-3500K=warm white, 4100 K=cool white, with 5000K and higher being bright white. Thus, manufacturers need to make and reseller need to stock a great number of different U-bend fluorescent lamps to meet customer demands. In additional to the larger number of Stock Keeping Units (SKUs), these U-bend fluorescent bulbs and their packaging take up additional room when packaged, stored, and shipped, and can be susceptible to breakage.

With the transition from fluorescent linear lamps to LED linear lamps rapidly taking place, current LED lamps products are being made in the same lengths as their predecessor straight tube fluorescent lamps, viz., 61.0 cm (2'), 122.0 cm (4'), and 244 cm (8') lengths, and U-bend lamps so that the LED lamps can replace the fluorescent linear lamps. Although LED linear lamps generally use plastic tubing instead of glass tubing and are therefore somewhat less susceptible to breakage compared to fluorescent lamps, many of the same issues regarding, storage, packaging, transportation, and handling remain, namely that in the case of straight lamps, long skinny objects are hard to handle and that U-bend lamps must be provided in a very large number of specifications to meet customer demand.

There accordingly remains a need for improved LED linear lamps and LED U-bend lamps to address these shortcomings.

SUMMARY OF THE INVENTION

The present invention addresses the issues with packaging and transporting of long and odd shaped lamps by providing LED linear lamp that comprises two or more sections which came be easily joined together to form LED linear lamps having a desired lengths and configurations which assemble takes place by a consumer or installer prior to installation. The approach is thus to ship the LED lamp in separate sections with quick connection assembly. This technique is to be applied on both linear lamps and U-bend shaped lamps.

One embodiment the invention provides a LED linear lamp assemblage comprising: at least two LED linear lamp sections, each LED linear lamp section comprising an elongated tube, a circuit board with a plurality of spaced apart LEDs, said circuit board being disposed within the tube, a connection at a first end of the at least two LED linear lamp sections for connecting to a power source, and an electrical connector on the at least two LED linear lamp sections; wherein the at least two LED linear lamp sections are connected at their second ends to establish electrical connection with their electrical connectors to form the LED linear lamp assemblage.

Another embodiment of the invention provides a LED linear lamp assemblage comprising: at least two LED linear lamp sections, each LED linear lamp section comprising an elongated tube with a transparent or translucent cover that connects to the base portion that defines a space inside, a circuit board with a plurality of spaced apart LEDs, said circuit board being disposed within the space of the tube, a connection at a first end of the at least two LED linear lamp sections for connecting to a power source, and an electrical connector on the at least two LED linear lamp sections; and a joiner unit for mechanically connecting the at least two LED linear lamps sections at their second ends, wherein the at least two LED linear lamp sections are connected at their second ends to establish electrical connection with their electrical connectors to form the LED linear lamp assemblage.

Yet another embodiment of the invention provides a U-shaped LED linear lamp assemblage comprising: two LED linear lamp sections, each LED linear lamp section comprising an elongated tube, a circuit board with a plurality of spaced apart LEDs, said circuit board being disposed within the tube, a connection at a first end of the at least two LED linear lamp sections for connecting to a power source, and an electrical connector on the at least two LED linear lamp sections; and a U-shaped lamp section having a circuit board with associated LEDs, which U-shaped lamp section has complementary electrical connectors at two ends; wherein the two LED linear lamp sections are connected at their second ends to the two ends of the U-shaped lamp section to establish electrical connection and form the U-shaped LED linear lamp assemblage.

These and other features of the invention are described below.

DETAILED DESCRIPTION

Figure 1:
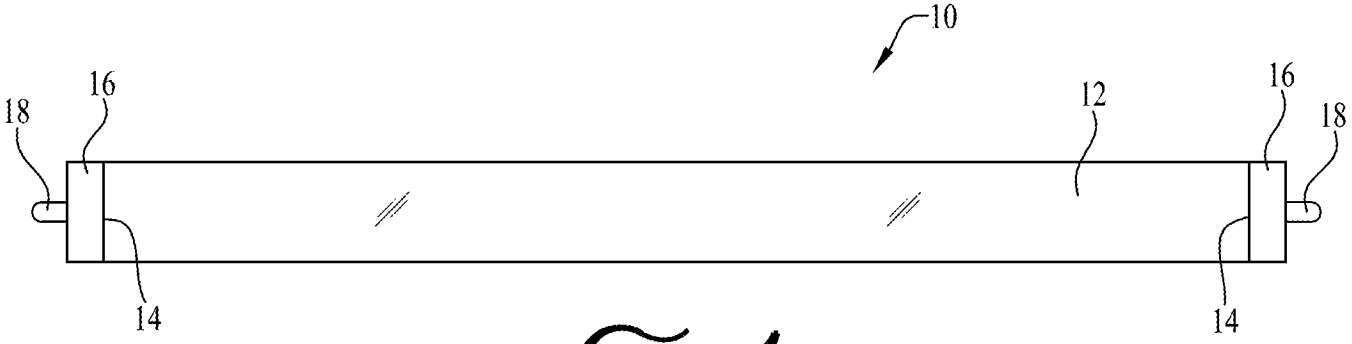
Fig. 1 PRIOR ART
FIG. 1 is a top view of a prior art fluorescent linear tube lamp.

Turning first to FIG. 1 is a top view of a prior art fluorescent linear tube lamp.

Figure 2:
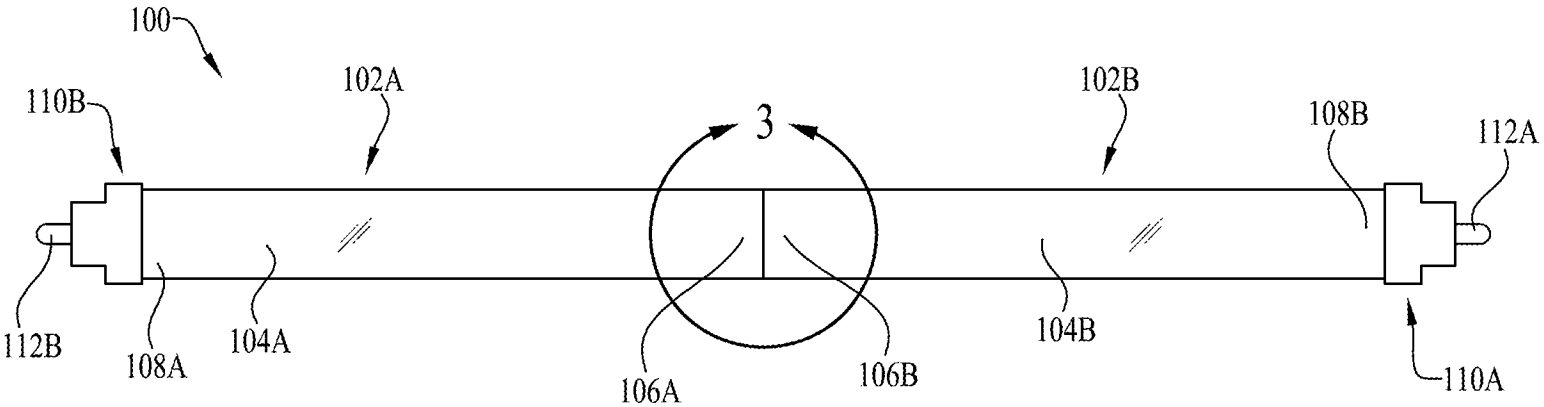
FIG. 2 is a top view of an exemplary embodiment of an LED linear lamp assemblage of the invention shown in its assembled state.

FIG. 2 is a top view of an exemplary embodiment of an LED linear lamp assemblage 100 of the invention shown in its assembled state. It includes two LED linear lamp sections 102A and 102B, each with tube sections 104A and 104B respectively, which two LED linear lamp sections 102A and 102B connect together at connection ends 106A and 106B, and at their opposite ends 108A and 108B having fixture ends 110A and 110B. The fixture ends 110A and 110B have one or two extending pins 112A and 112B depending on whether the assemblage 100 is a single pin or bi-pin model.

Figure 3:
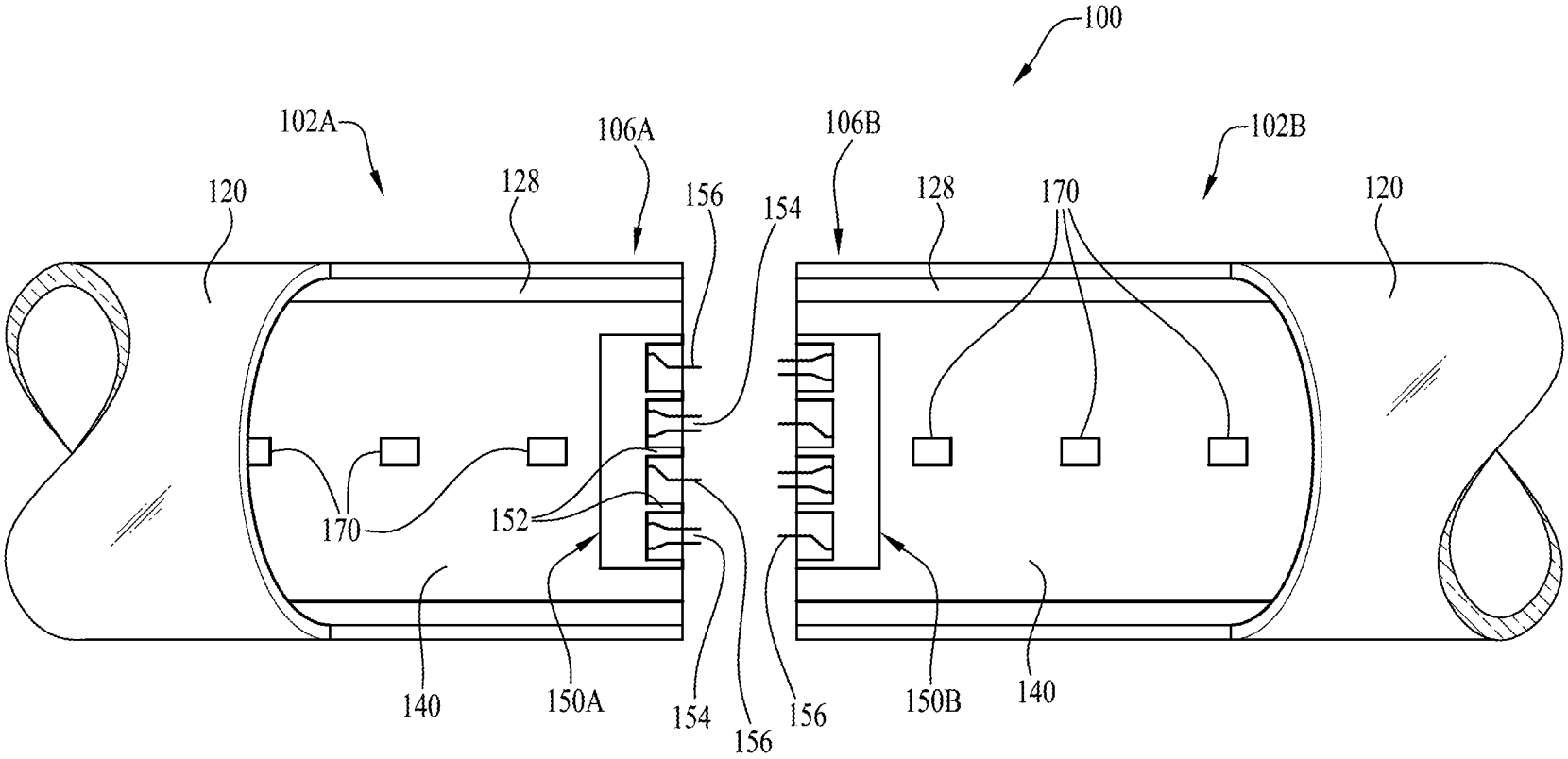
FIG. 3 is partially exposed detail view of the area shown in the circle 3-3 of FIG. 2, but with the two sections of the LED linear lamp assemblage partially separated.
Figure 4:
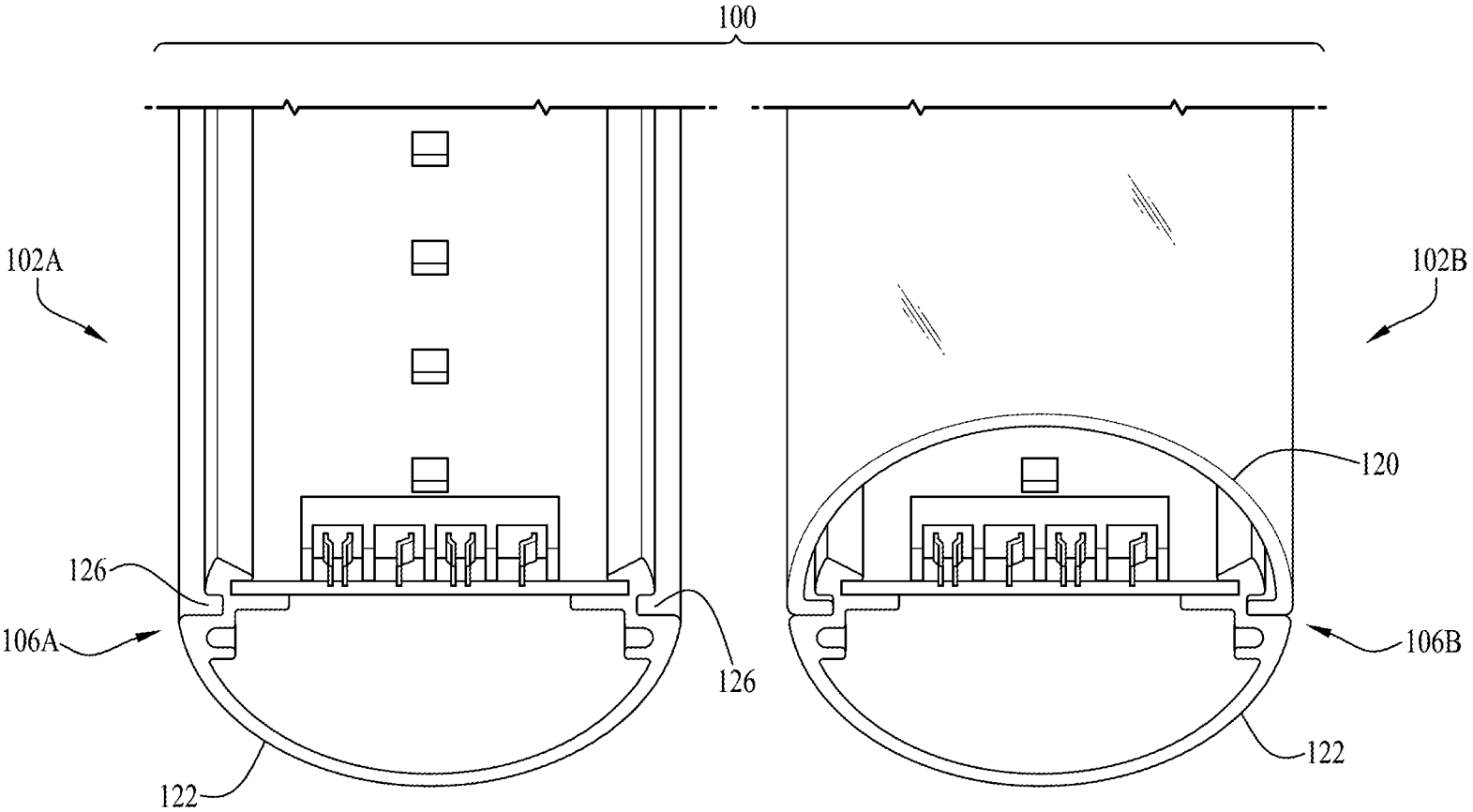
FIG. 4 is end isometric detail view showing the two joining ends of the two sections of the LED linear lamp assemblage of FIG. 2 with the transparent or translucent lens or cover removed on one of the sections.
Figure 5:
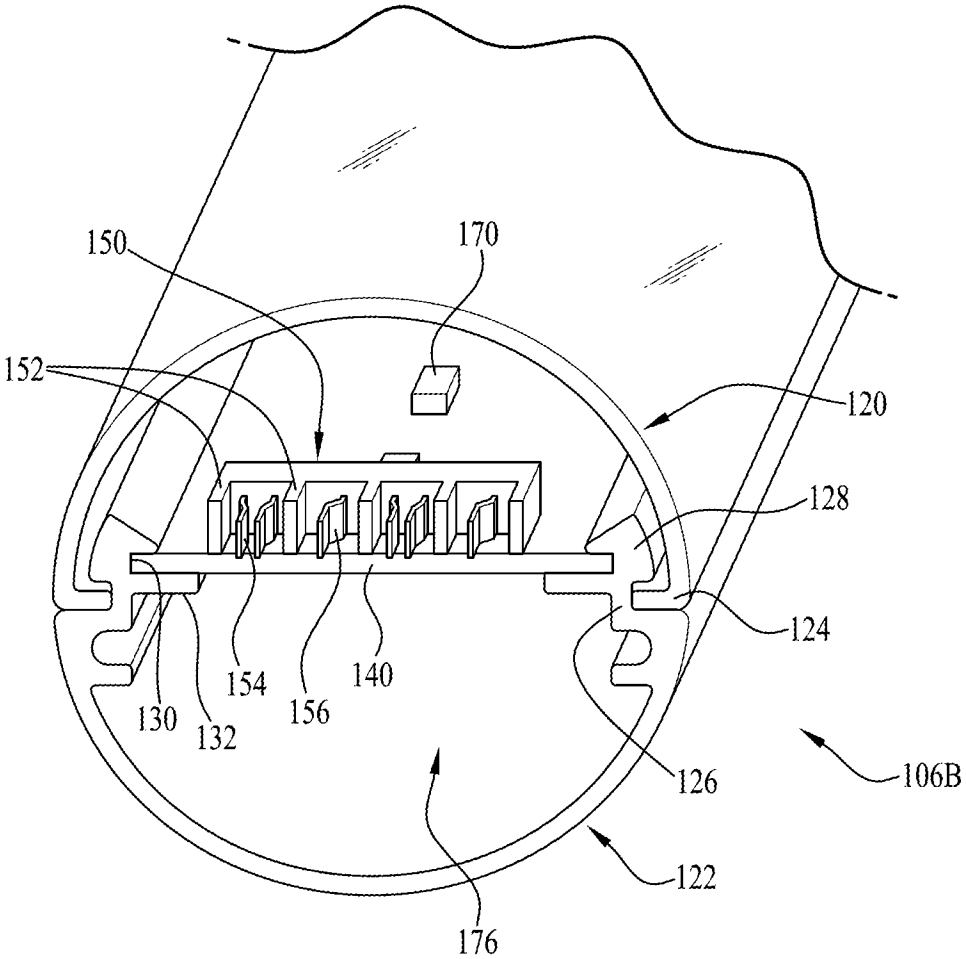
FIG. 5 is another detailed end isometric view showing the joining end of one section of the LED linear lamp assemblage of FIG. 2 with the transparent or translucent cover in place.
Figure 6:
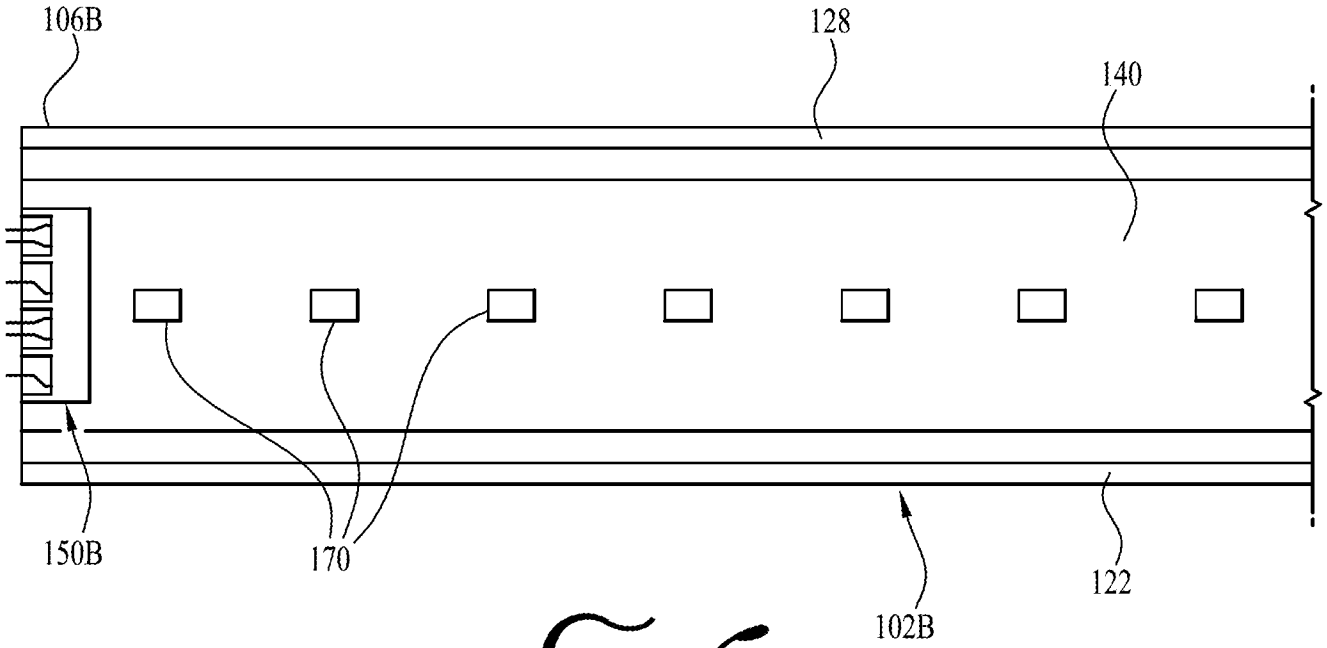
FIG. 6 is a top view of the joining end of one section of the LED linear lamp assemblage of FIG. 2 with the transparent or translucent cover removed to show its circuit board, LEDs, and electrical connector.

FIG. 3 is partially exposed detail of the area shown in the circle 3-3 of FIG. 2, but with the two sections 102A and 102B of the LED linear lamp assemblage 110 partially separated. FIG. 4 is end isometric detail view showing the two joining ends 106A and 106B of the two sections 102A and 102B of the LED linear lamp assemblage 100 of FIG. 2 with the transparent or translucent cover 120 removed from section 102B. FIG. 5 is another detailed end isometric view showing the joining end 106B of section 106B of the LED linear lamp assemblage 100 of FIG. 2 with the transparent or translucent cover 120 in place. FIG. 6 is a top view of the joining end 106B of section 102B of the LED linear lamp assemblage of FIG. 2 with the transparent or translucent cover removed from the base 22 to show the circuit board 140, LEDs 170, and electrical connector 150B. In the LED linear lamp assemblage 100 each section 102A and 102B has a transparent or translucent cover 120 that engages with a base 122. The base can be made of rigid plastic or metal, such as extruded aluminum. The joining of the transparent or translucent cover 120 with a base 122 can be accomplished by the transparent or translucent cover 120 having a semi-circular cross section with inwardly turned legs 124. The legs 124 of the transparent or translucent cover 120 will snap into place into grooves 126 formed at both sides at the top of the base 122 and secure the transparent or translucent cover 120 to the base 122. In each section 102A/102B, LEDs 170 are located on the top of a circuit board 140. The circuit boards 140 is retained at both sides by circuit board rails 128 that have a slot 130 and supports 132 which are part of the base 122. On the circuit boards 140 at the joining ends 106A and 106B are electrical connectors 150A and 150B, each having electrical contacts 154 and 156 that are separated by dividing walls 152. When the two LED linear lamp sections 102A and 102B are brought together so that their joining ends 106A and 106B make contact, the contacts 154 and 156 of their electrical connectors 150A and 150B will engage with each other, and complete the circuit between the two sections to form the LED linear lamp assemblage 100. A generally D-shaped space 176 will be defined below the circuit board 140 and inside around the base 122. This space 176 is available for use of a joining unit 190, as is shown and described with respect to FIGS. 7-12 below.

Figure 7:
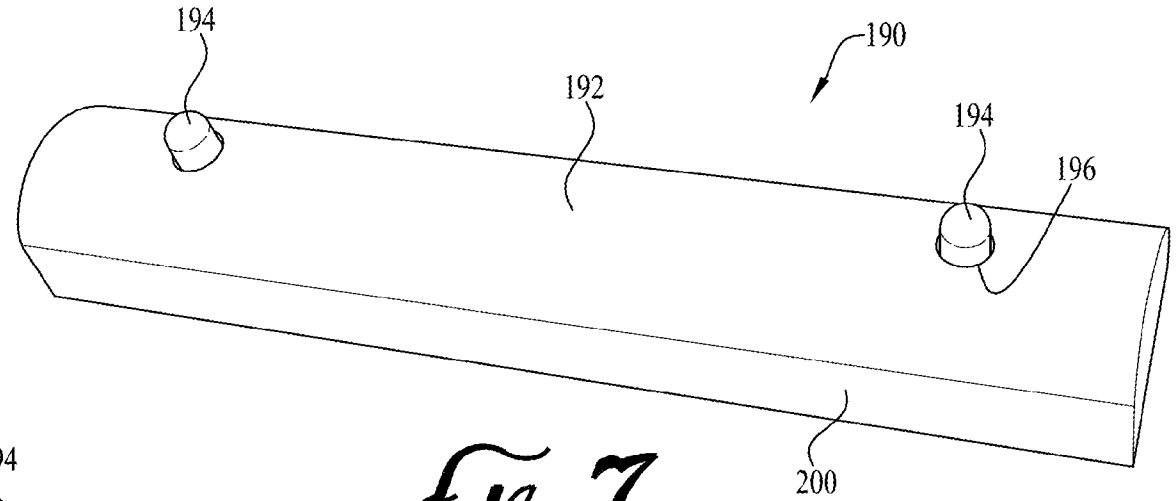
FIG. 7 is a back isometric view showing an exemplary joiner unit for mechanically joining together the two LED linear lamp sections.
Figure 8:
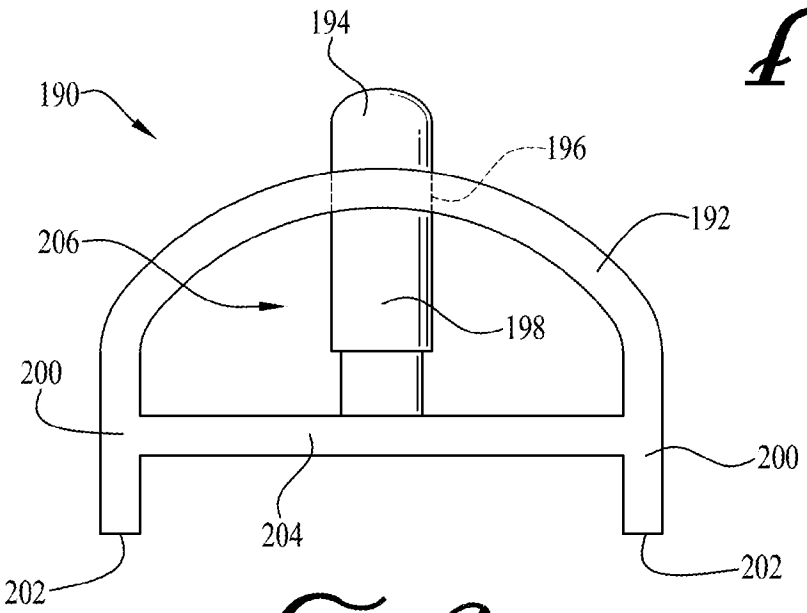
FIG. 8 is an end view of the joiner unit of FIG. 7.

FIG. 7 is an isometric back view and FIG. 8 is an end view showing an exemplary joiner unit 190 for mechanically joining together LED linear lamp sections. The joiner unit 190 has a generally D-shaped profile that is slight smaller than and adapted to slide into the D-shaped space 176 formed in the base 122 below the circuit board of the LED linear lamp sections 102A and 102B. The joiner unit 190 has an arched wall 192, two leg portions 200 with ends 202, and a bottom wall 204. The joiner unit 190 has an internal space 206 into which fits a spring 198 attached to a spring pin 194. The spring 198 biases the spring pin 194 to movably extend through an aperture 196 formed in the arched wall 192. If the spring pin 194 is pushed downwardly, the spring pin 194 will move back into the aperture 196 and into the internal space 206. Other arrangement to move the spring pin 194 can be used.

Figure 9:
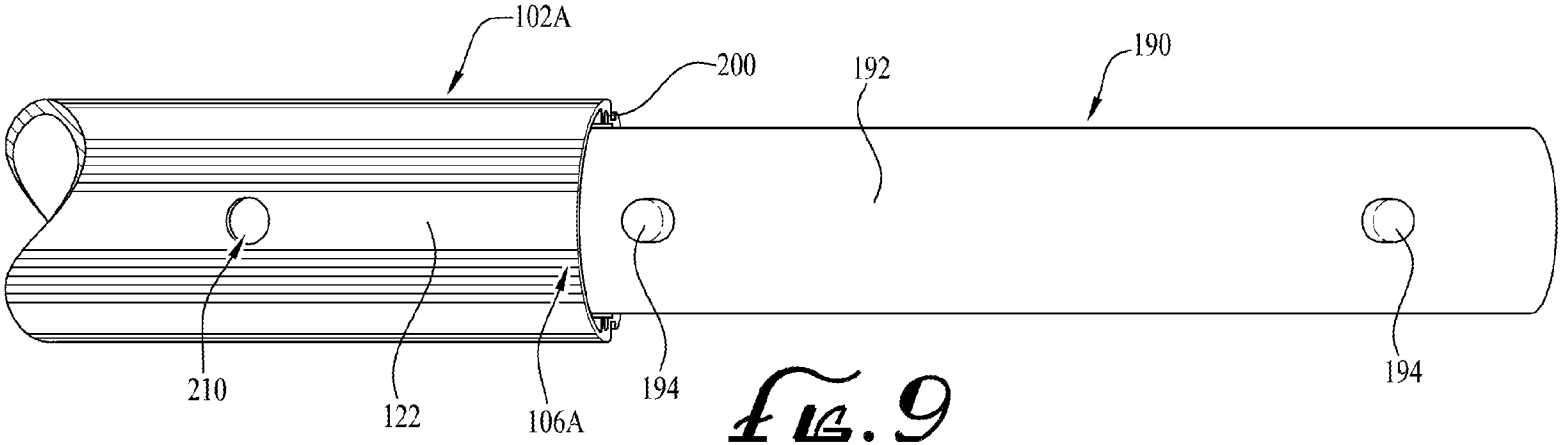
FIG. 9 is a bottom view showing the joiner unit of FIG. 7 partially inserted into one of the LED linear lamp section.
Figure 10:
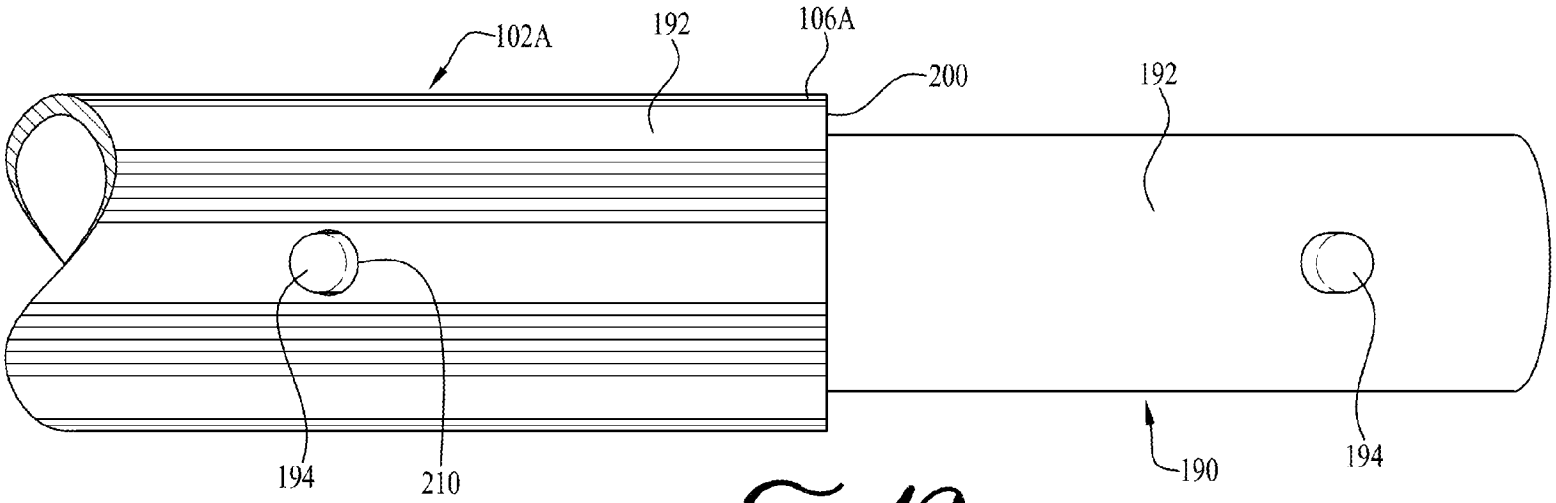
FIG. 10 is a bottom view showing the joiner unit of FIG. 7 completed inserted and engaged with one of the LED linear lamp section.
Figure 11:
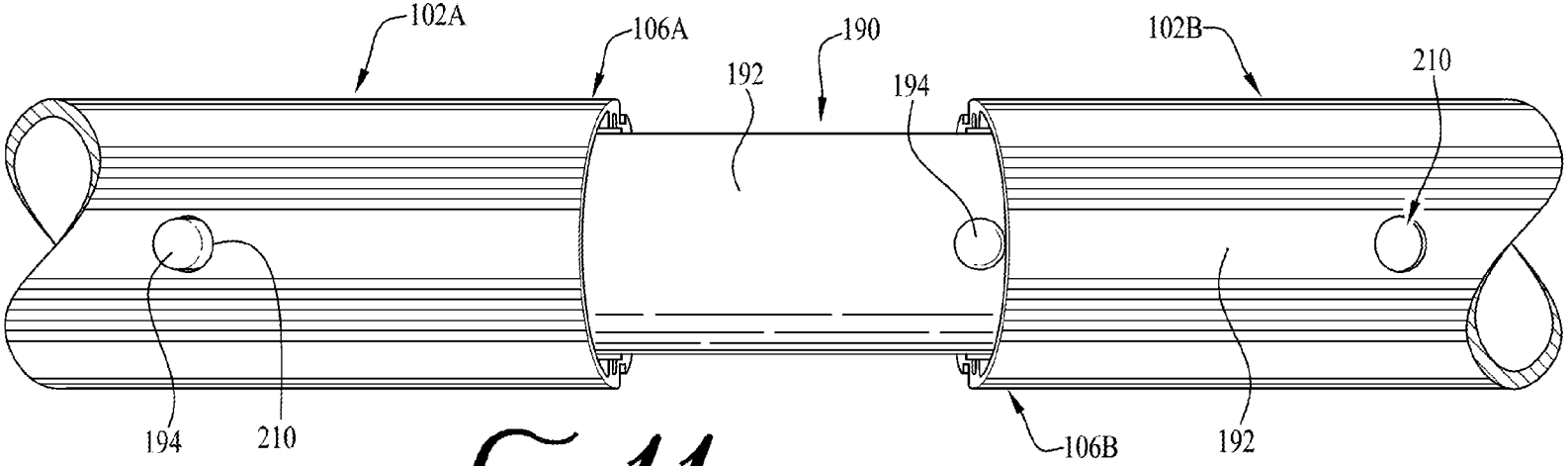
FIG. 11 is a bottom view showing the joiner unit of FIG. 7 completed inserted and engaged with one of the LED linear lamp section and partially inserted into the other LED linear lamp section.

FIG. 9 is a bottom view showing the joiner unit 190 of FIG. 7 partially inserted into the LED linear lamp section 102A; FIG. 10 is a bottom view showing the joiner unit 190 completed inserted and engaged with the LED linear lamp section 102A; and FIG. 11 is a bottom view showing the joiner unit 190 completed inserted and engaged with LED linear lamp section 102A and partially inserted into LED linear lamp section 102B. As can be seen, the joiner unit's arched wall 192 rides adjacent to the base 122 with the two leg portions 200 also riding inside the LED linear lamp section 102B. As the joiner unit 190 is pushed further into place as shown in FIG. 10, the pin catch 194 will spring though a catch hole 210 formed in the base 122 and lock the joiner unit 190 into the LED linear lamp section 102A. The other section 102B is similar joined and locked with the joiner unit 190.

Figure 12:
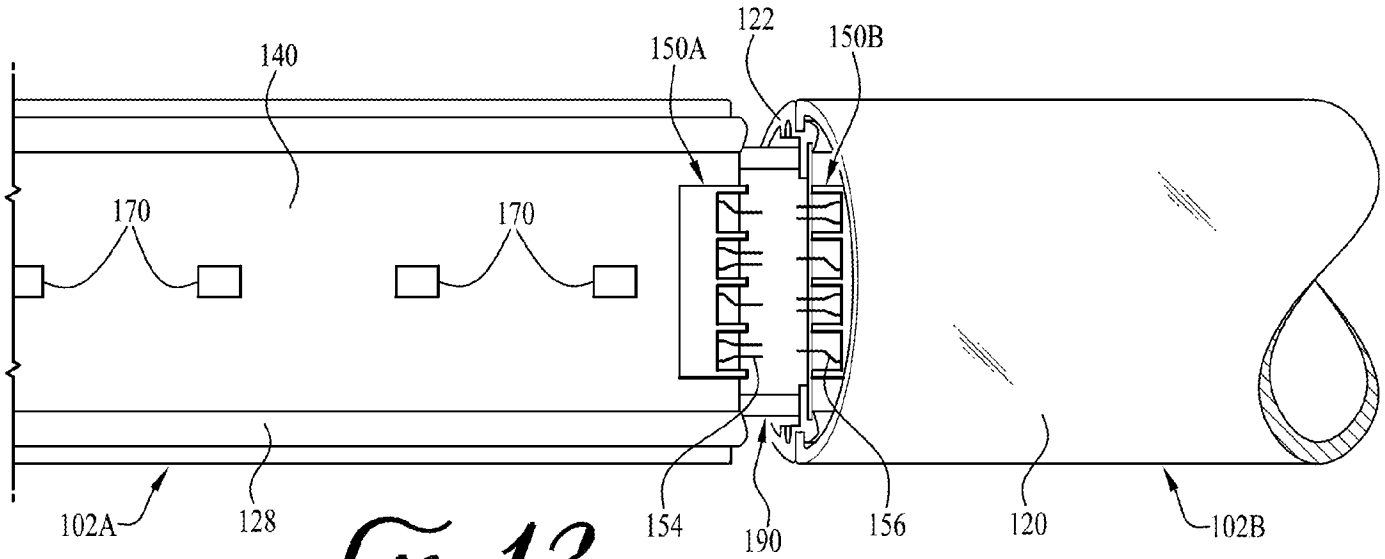
FIG. 12 is a top view showing the exemplary joiner unit of FIG. 7 completed inserted and engaged with one LED linear lamp section and partially inserted into the other LED linear lamp section, with the two electrical connectors just before they are engaged with each other.

FIG. 12 is a top view showing the joiner unit 190 completed inserted and engaged with LED linear lamp section 102A and partially inserted into LED linear lamp section 102B, with the two electrical connectors 105A and 150B just before they engage with each other. The circuit boards 140 with LEDs 170 of unit 102B are shown fixed by the circuit board rails 128 to the base 122 and the cover 120 is shown attached to the LED linear lamp section 102B. As can be seen the electrical contacts 154 and 156 are designed to positively yet detachably establish electrical continuity between the LED linear lamp sections 102A and 102B.

Figure 14:
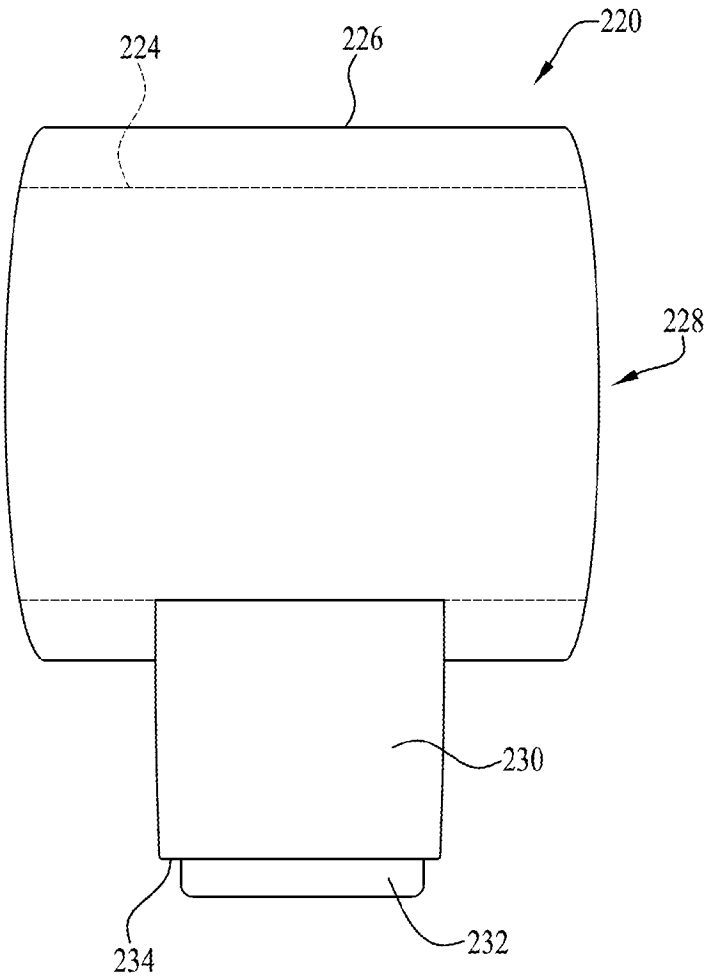
FIG. 14 is a side view of the clear joining ring of FIG. 13.
Figure 13:
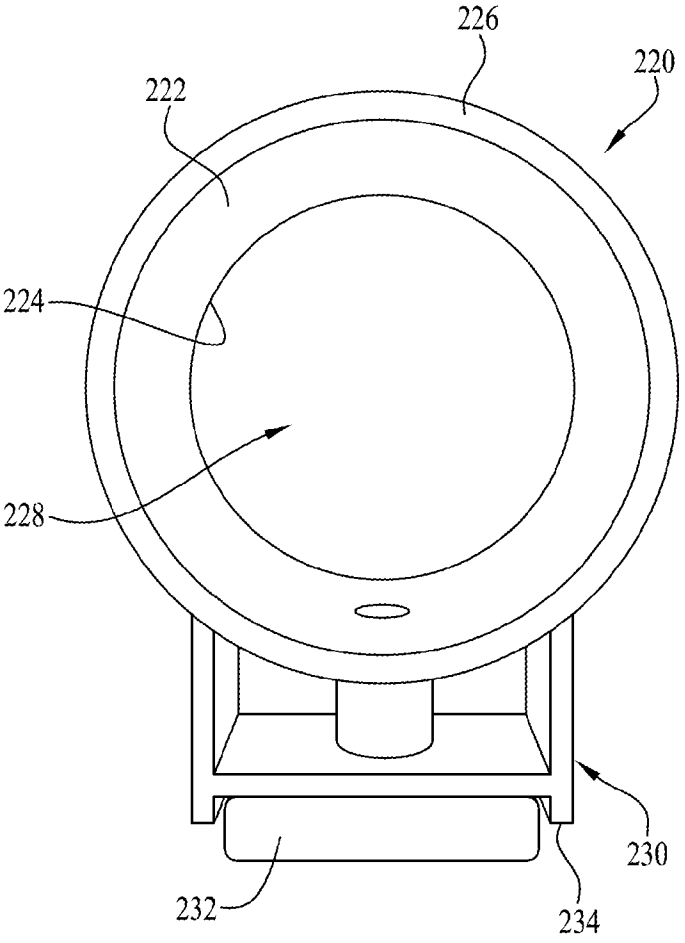
FIG. 13 is an end view of an exemplary clear joining ring used with the LED linear lamp assemblage of FIG. 2.

FIG. 13 is an end view and FIG. 14 is a side view of an exemplary clear joining ring 220 used with the exemplary embodiment of the LED linear lamp assemblage 100 of FIG. 2. The joining ring 220 has a circular sleeve 222 with an inner surface 224 and an outer surface 226 and defines a circular passageway 228 that has a diameter just slightly larger than an external diameter of the joining ends 106A and 106B of the LED linear lamp sections 102A and 102B so that when the joining ring 220 is slid over the joining ends 106A and 106B of the LED linear lamp sections 102A and 102B it will help retain these two sections together. An extension 230 optionally extends from one side of the circular sleeve 222. A magnet 232 is located on a base 234 of the extension 230, the purpose of which is explained further below.

Figure 15:
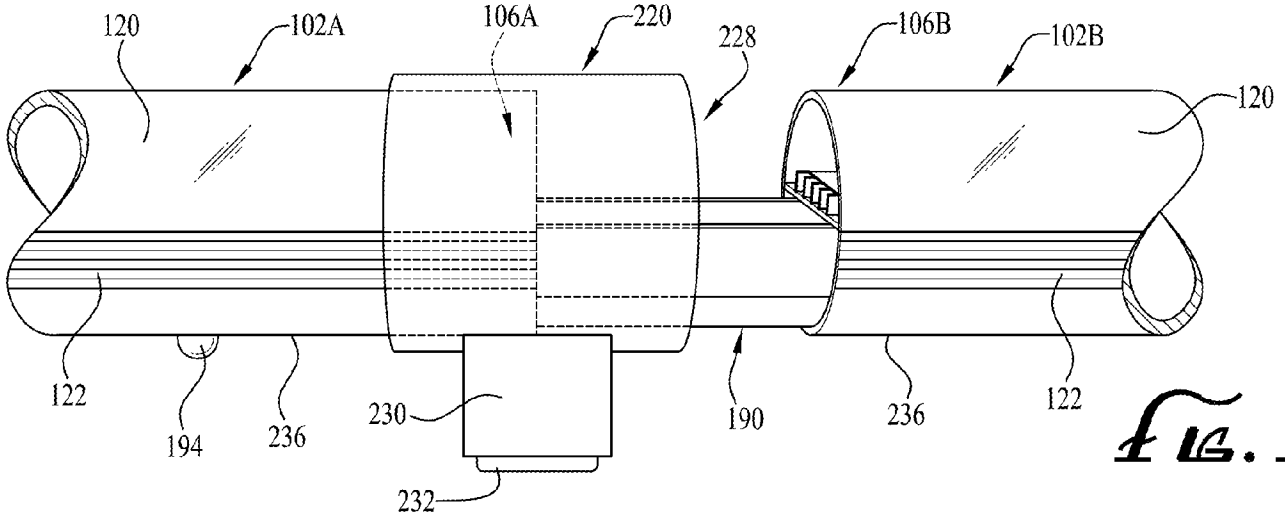
FIG. 15 is a side view the clear joining ring of FIG. 13 installed on the two LED linear lamp sections of FIG. 2, which sections are partially separated.

FIG. 15 is a side view the joining ring 220 installed on the two LED linear lamp sections 102A and 102B, with the extension 230 directed opposite the transparent or translucent cover 120, with the sections partially separated so that their connection ends 106A and 106B are separated. In this view, the joiner unit 190 and its spring pin 194 fully engage the LED linear lamp section 102A but not the LED linear lamp section 102B.

Figure 16:
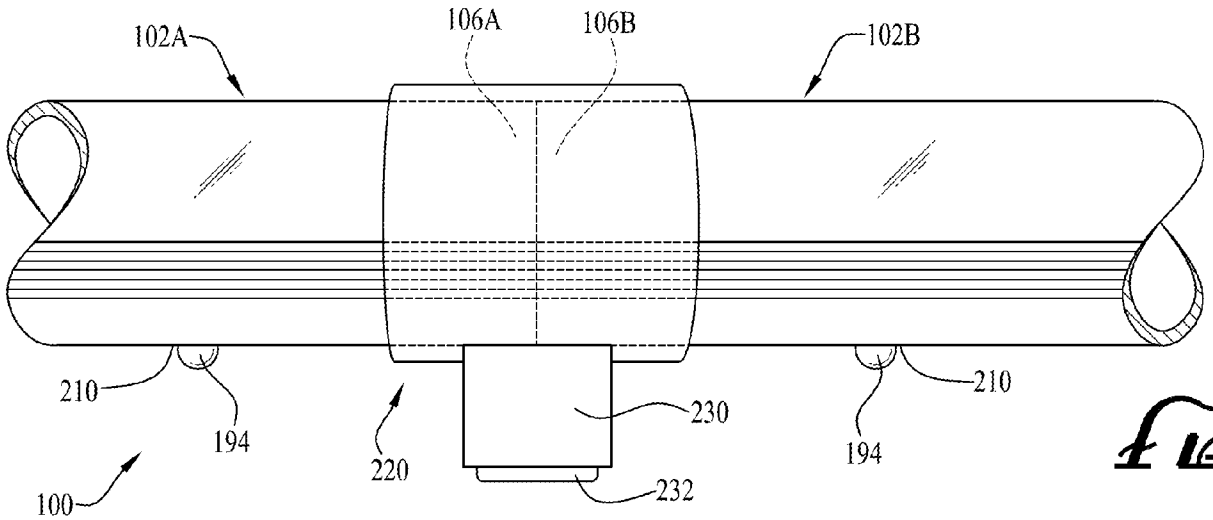
FIG. 16 is a side view the clear joining ring of FIG. 13 installed on the two now engaged LED linear lamp sections of FIG. 2.
Figure 17:
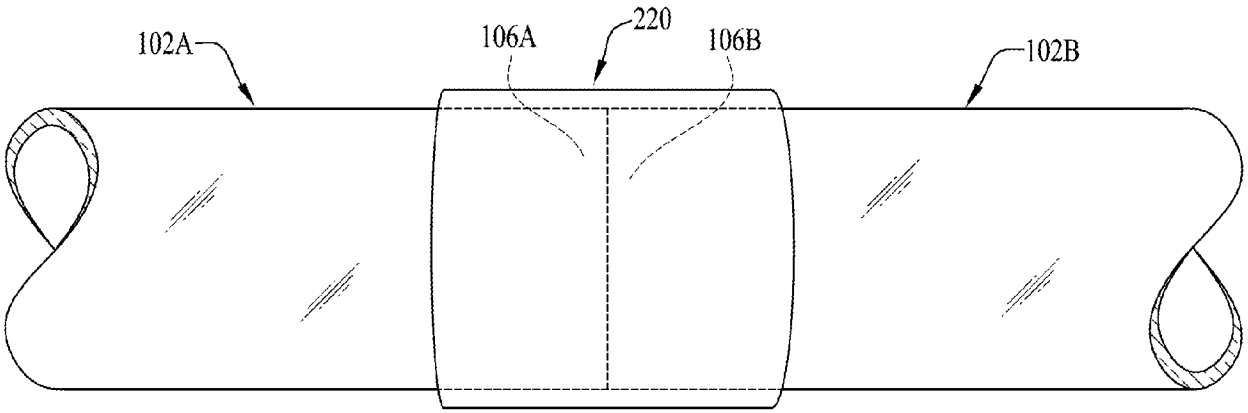
FIG. 17 is a top view the clear joining ring of FIG. 13 installed on the two now engaged LED linear lamp sections of FIG. 2.
Figure 18:
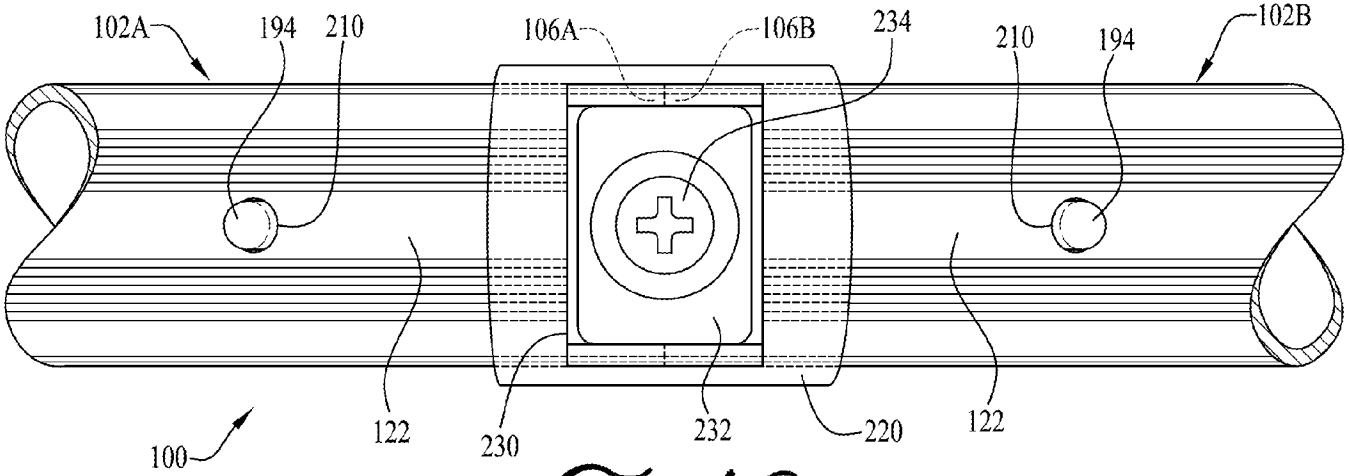
FIG. 18 is a bottom view the clear joining ring of FIG. 13 installed on the two now engaged LED linear lamp sections of FIG. 2.

FIG. 16 is a side view, FIG. 17 is a top view, and FIG. 18 is a bottom view showing the joining ring 220 installed on the two LED linear lamp sections 102A and 102B, which are completely engaged with each other with the spring loaded pins 194 of the joiner (not shown) fully engaged with the catch hole 210 formed in the base 122 of the two LED linear lamp sections 102A and 102B thereby forming the LED linear lamp assemblage 100. FIG. 18 shows a screw 234 holding the magnet 232 to the bottom of the extension 230. As can be seen, the magnet 232 on the extension 230 is spaced below a bottom surface 236 of the base 122 of the LED linear lamp sections 102A and 102B. When the LED linear lamp assemblage 100 is installed in a light fixture generally having a reflector or ballast cover made of ferrous metal (not shown), the magnet will help support the middle part of the LED linear lamp assemblage where the two LED linear lamp sections 102A and 102B join together and help prevent possible sagging of the LED linear lamp assemblage.

Figure 19:
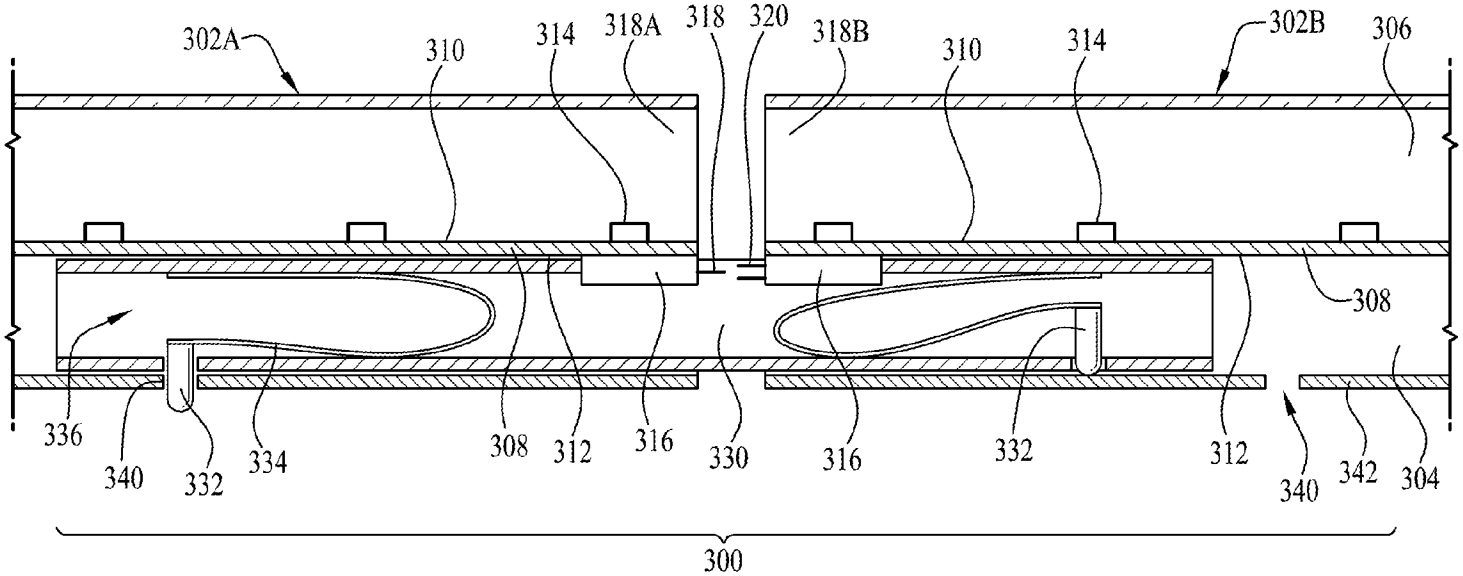
FIG. 19 is a partially exposed detail side view of another exemplary embodiment of a LED linear lamp assemblage of the invention with the sections of the assemblage partially separated.

FIG. 19 is a partially exposed detail side view of another exemplary embodiment of a LED linear lamp assemblage 300 of the invention with LED linear lamp sections 302A and 302B of the assemblage partially separated. A joiner unit 330 is shown fully engaged with the LED linear lamp section 302A so that its spring pin 332 passes through a catch hole 340 formed in a bottom wall 342 of a base 304 of the two LED linear lamp sections 102A and 102B. The spring loaded pins 332 are biased with springs 334 located in a space 336 in the base 304 below the circuit boards 308. As shown, the spring pin 332 shown on the right side is not aligned with the catch hole 340 formed in the LED linear lamp section 302B so does not lock in place. In this embodiment, the LEDs 314 extend above a top 310 of the circuit boards 308 and instead of having electrical connectors 316 also located on a top surface 310 of the circuit boards 308, the electrical connectors 316 are mounted on a bottom surface 312 of the circuit board 308. As with the prior embodiment, electrical contacts 318 and 320 extend outwardly from both electrical connectors 316 and when the two sections are moved together, the electrical contacts 318 and 320 engage and make electrical connection. This embodiment is designed to help ensure that the light density and quality that emanates from the region where the two LED linear lamp sections 302A and 302B are joined is approximately equal to that of other areas of LED linear lamp sections 302A and 302B, and is accomplished by moving its electrical connectors from the top of the surface board where there are LEDs, to the bottom of the circuit board, where there are no LEDs, thus permitting more flexibility in the placement of the LEDs.

Figure 20:
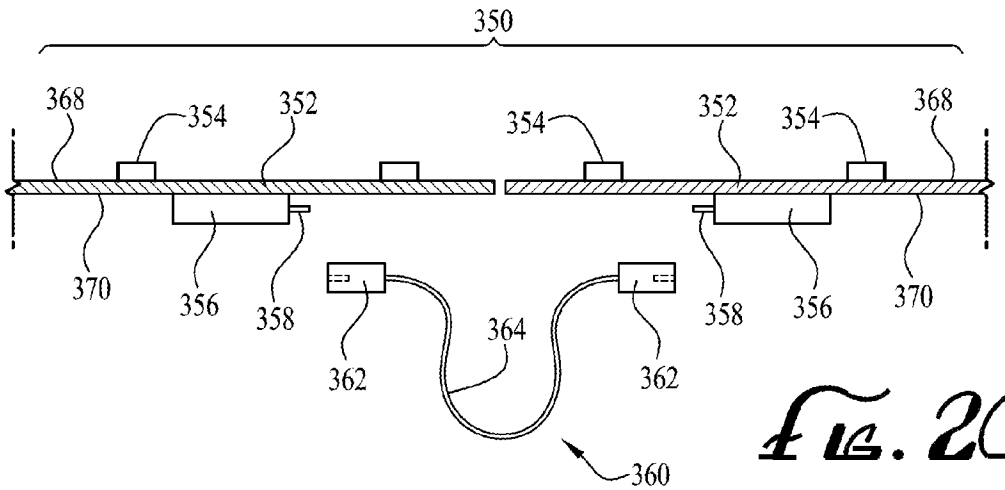
FIG. 20 is a detail side view showing portions of an alternate construction of the LED linear lamp assemblage of the invention.

FIG. 20 is a detail side view showing portions 350 of an alternate construction of the LED linear lamp assemblage of the invention. This view leaves out the base and lens cover, but shows two circuit board 352 with LEDs 354 extending above an upper surface 368, and with electrical connectors 356 with leads 358, the electrical connectors 356 affixed below a bottom surface 370 of the circuit boards 352. The circuit boards can be space apart and will have contacts 258. In this embodiment, there is also provided a wire harness 360 with connector ends 362 and connecting wires 364 joining the connector ends 362. To electrically connect the electrical connectors 356 and their leads 358, the connector ends 362 of the wire harness 360 will be connected to the leads 358 of the electrical connectors 356. This embodiment is also designed to help ensure that the light that emanates from the region where the two LED linear lamp sections are joined is even, and is accomplished by moving its electrical connectors from the top of the surface board where there are LEDs, to the bottom of the circuit board, where there are no LEDs, and using a wire harness, to permit even greater flexibility in the placement of the LEDs. Another advantage of this embodiment is that it basically eliminates spacing issues of the ends of the two circuit boards in the two sections being joined. Furthermore, the two LED linear lamp sections of this embodiment can be sold and shipped with the wire harness already in connected in place, with the joining process just a matter of snapping the two LED linear lamp sections together to form the assemblage.

Figure 21:
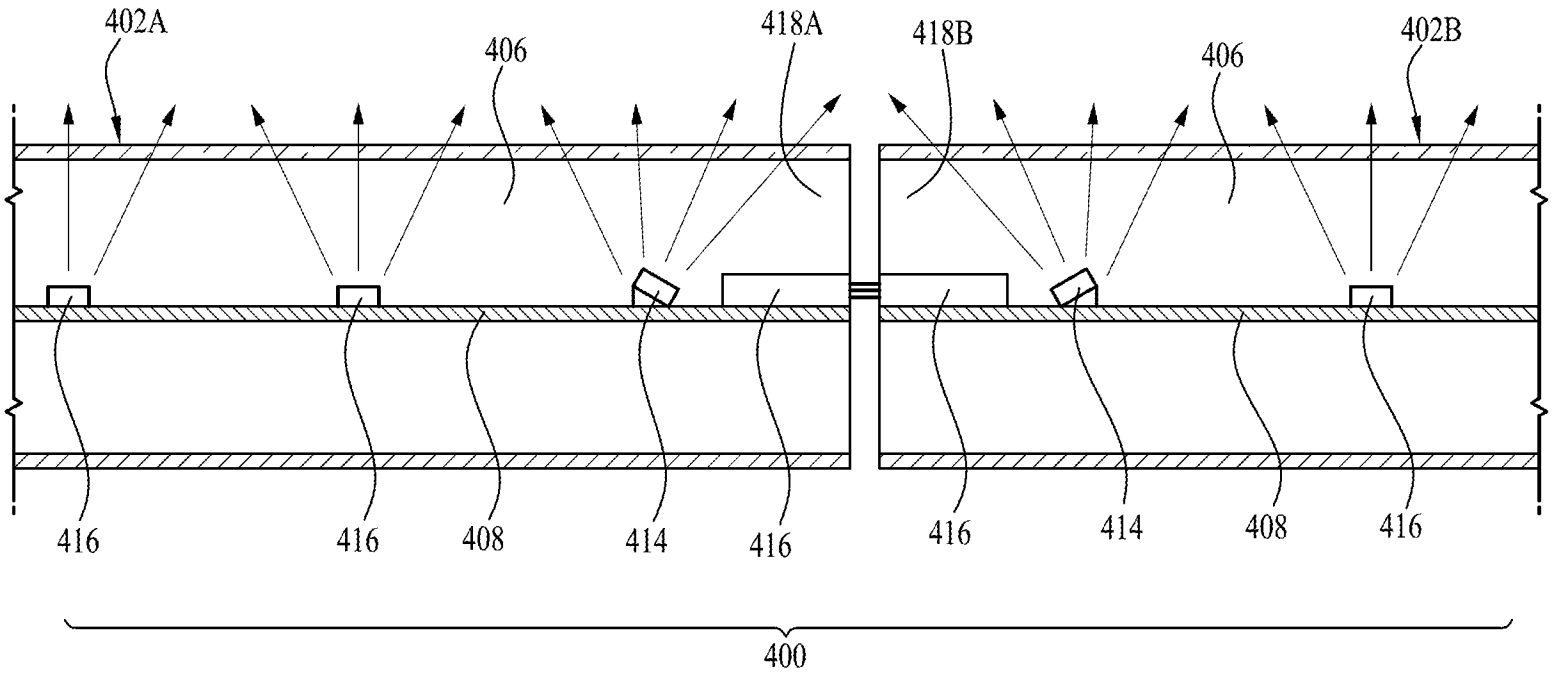
FIG. 21 is a partially exposed detail side view of yet another exemplary embodiment of a LED linear lamp assemblage of the invention.

FIG. 21 is a partially exposed detail side view of yet another exemplary embodiment of a LED linear lamp assemblage 400 of the invention. It has two LED linear lamp sections 402A and 402B with electrical connectors 416 on their circuit boards 408, which also carry LEDs 414 and 416. In this embodiment, the electrical connectors 416 are on a top surface of the circuit boards 408 near joining ends 418A and 418B of the LED linear lamp sections 402A and 402B. The LEDs 414 near the joining ends 418A and 418B of the LED linear lamp sections 402A and 402B will be tilted towards the joining ends 418A and 418B so that they cast more of an overlapping light outwardly from the transparent or translucent cover 406 of the LED linear lamp sections 402A and 402B to mask any possible gap this might otherwise be noticeable by the lack of one or two LEDs that would be presented in the space occupied by the electrical connectors 416. Alternately, instead of tiling the LEDs 414 can be a slightly higher intensity and/or cast light in a wider range than the other LEDs 416.

Figure 22:
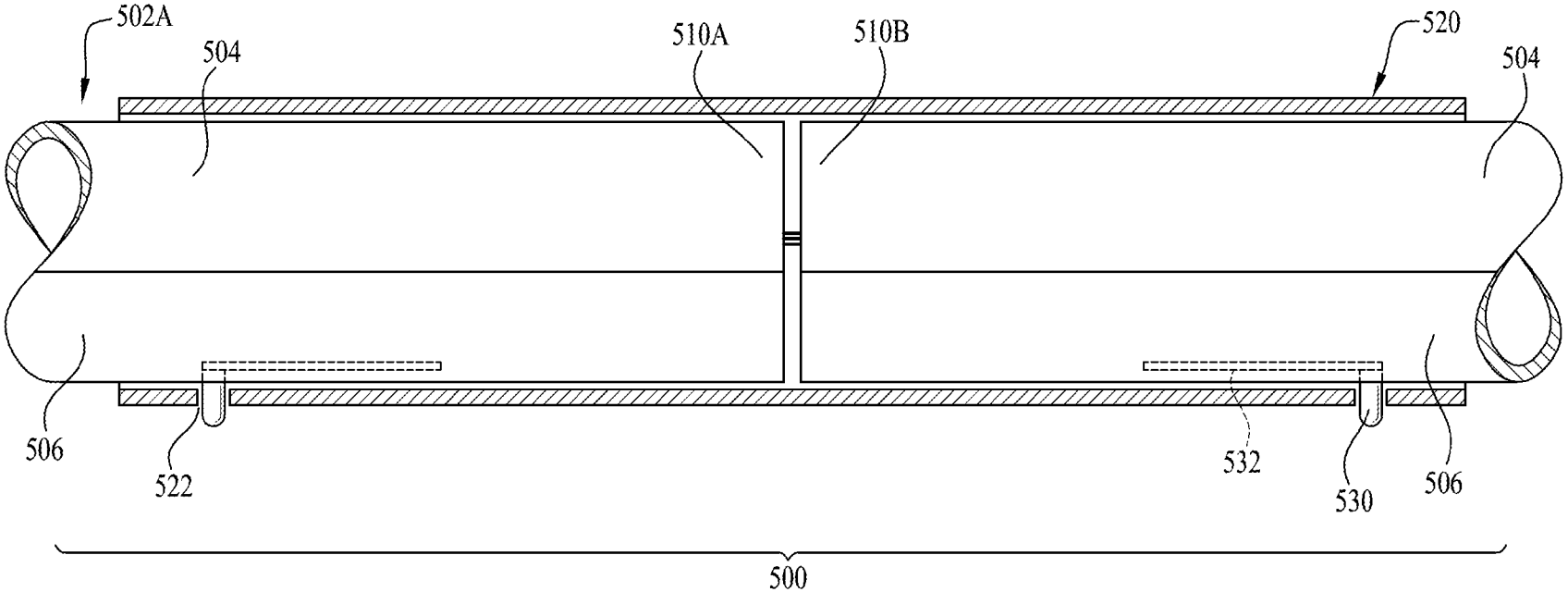
FIG. 22 is a partially exposed detail side view of yet a further exemplary embodiment of a LED linear lamp assemblage of the invention showing another exemplary embodiment of a joiner unit.

FIG. 22 is a partially exposed detail side view of yet a further exemplary embodiment of a LED linear lamp assemblage 500 of the invention that shows another exemplary embodiment of a joiner unit 520. Spring clips 532 with spring loaded pins 530 are located in each of two LED linear lamp sections 502A and 502B and pass through and are captured in catch holes 522 formed in a wall of the joiner unit 520 which preferably comprises a clear tube. The clear tubular joiner unit 520 will thus capture joining ends 510A and 510B of the two LED linear lamp sections 502A and 502B and overlay the transparent or translucent cover 504 and the bases 506 thereof. The use of the clear tubular joiner unit 520 may obviate a need for an internally positioned joiner unit 190, such as shown in FIGS. 7-15.

Figure 23:
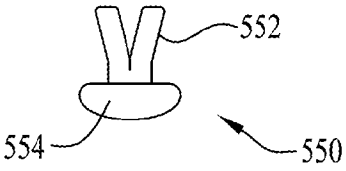
FIG. 23 is a side view of an exemplary push pin used to fix a joining unit to the LED linear lamp sections.

FIG. 23 is a side view of an exemplary push pin 550 used to connect a joining unit 520 such as described with reference to FIG. 22. The push pin 550 has shaft 552 and a head 554. The shaft will preferably expand when inserted in place, such as through the catch holes 522 formed in a wall of the clear tubular joiner unit 520 of FIG. 22, in which case no spring clips 532 with spring loaded pins 530 are required.

Figure 24:
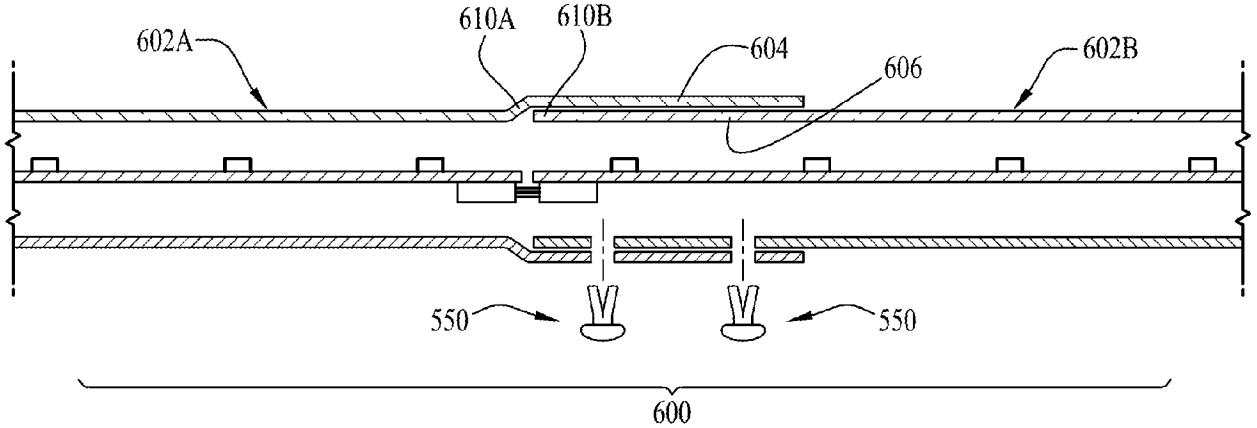
FIG. 24 is a partially exposed side view of a still further exemplary embodiment of a LED linear lamp assemblage of the invention wherein a joiner unit is integrated with one of the two LED linear lamp sections.

FIG. 24 is a partially exposed side view of another exemplary embodiment of a LED linear lamp assemblage 600 of the invention wherein a joiner 604 is integrated with the LED linear lamp section 602A. The joiner 604 comprises an enlarged internal diameter tube section that extends beyond a joining end 610A of the LED linear lamp section 602A. The slightly enlarged internal diameter tube section is sized to slidingly engage with a joining end 610B of the LED linear lamp section 602B and tightly and securely hold the two LED linear lamp sections 602A and 602B together. The enlarged internal diameter joiner tube section 604 can comprise a tubular extension of the transparent or translucent cover for the LED linear lamp section 602A. Push pins 550, such as those shown and described with reference to FIG. 23, can be used to retain the two LED linear lamp sections 602A and 602B together.

Figure 25:
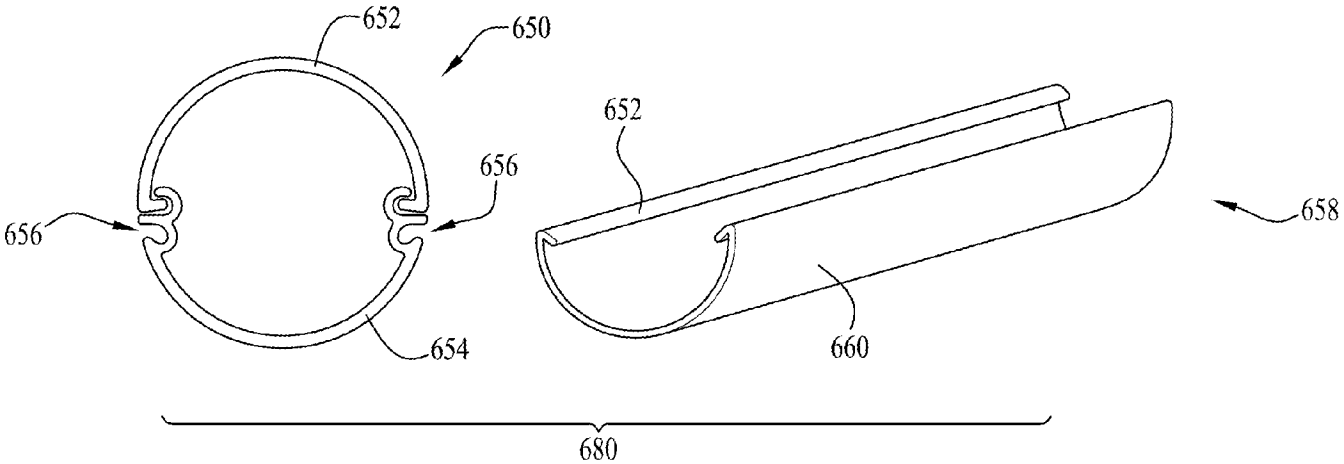
FIG. 25 is a cross-sectional view of a section of an exemplary embodiment of yet another LED linear lamp section of the invention and an isometric view of a joiner unit used to hold these LED linear lamp sections together.

FIG. 25 is a cross-sectional view of a section of an exemplary embodiment of yet another LED linear lamp section 650 of the invention and an isometric view of a joiner unit 658 used to connect two LED linear lamp sections together. The LED linear lamp section 650 has a transparent or translucent cover 652 that engages with a base 654. The base 654 has a groove 656 formed on outer walls thereof. The joiner unit 658 has a contour similar to that of the base 654 including an ached wall with legs 652 at the ends thereof. The joiner unit 658 is formed of high strength springy material, such as spring steel, and the joiner unit 658 is used to join together two LED linear lamp section 650 by pushed the joiner unit 658 onto the base unit such that its legs 652 will spring into place and be retained by the grove 656 of the base 654, thereby locking the joiner unit 658 and two LED linear lamp section 650 together.

Figure 26:
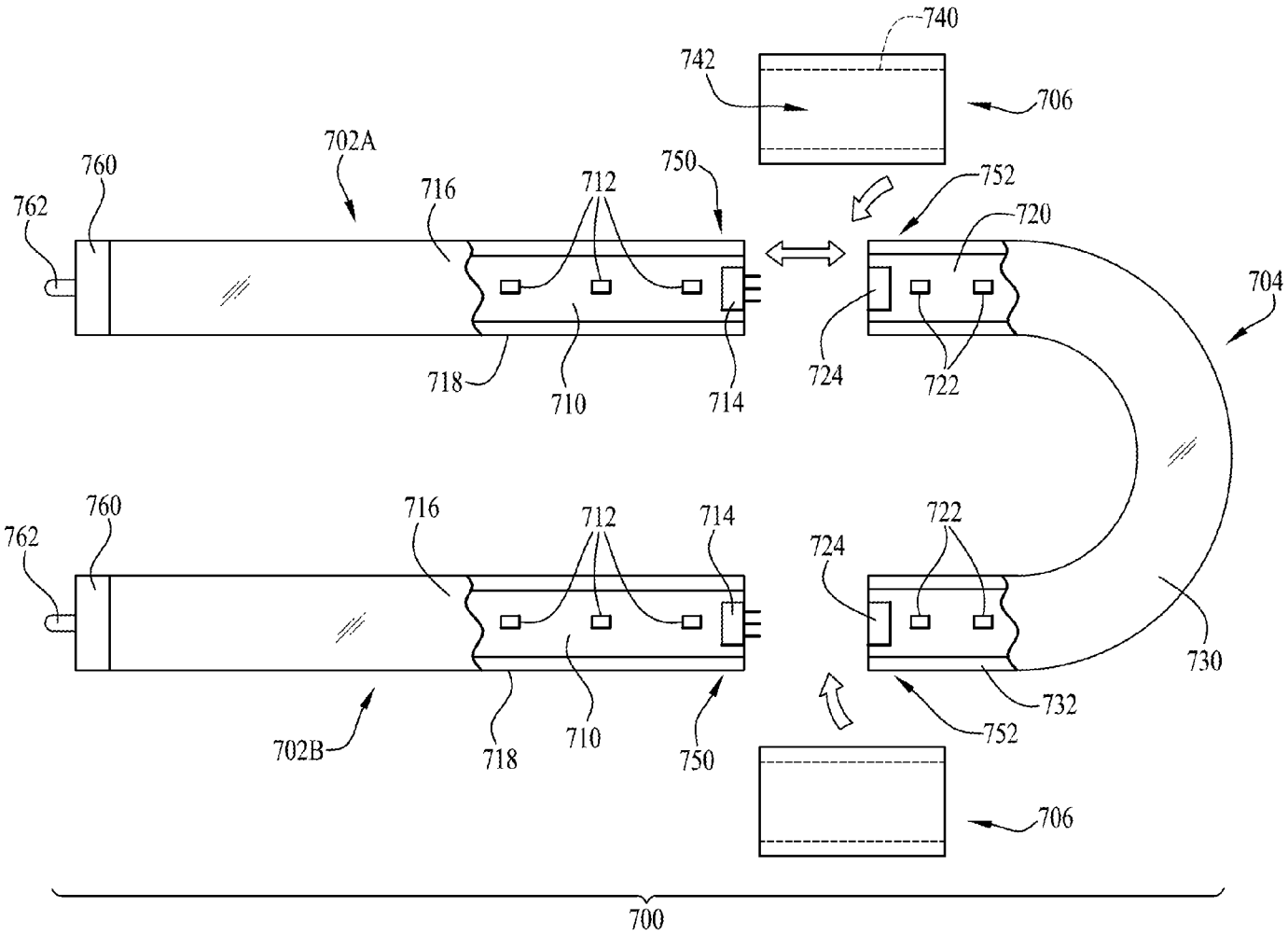
FIG. 26 is a partially exposed top view of an exemplary embodiment of a U-shaped LED linear lamp assemblage of the invention.

FIG. 26 is a partially exposed top view of an exemplary embodiment of a U-shaped LED linear lamp assemblage 700 of the invention. It has two straight tubular LED lamp sections 702A and 702B and a U-shaped lamp section 704. Joiner units 706 are provided to join the two straight tubular LED lamp sections 702A and 702B to the U-shaped tubular lamp section 704 in the completely assembled assemblage. The straight tubular LED lamp sections 702A and 702B each include a circuit board 710 with LEDs 712 and an electrical connector 714. The circuit boards are mounted to a base 718 and a transparent or translucent cover 716 is attached to the base 718 above the LEDs. The electrical connector 714 are mounted at joining ends 750, and opposite the joining ends 750 there are fixture ends 760 with one or two extending pins 762. The pins establish electrical contact with a fixture into which the U-shaped LED linear lamp assemblage 700 will be installed. The U-shaped lamp section 704 has a circuit board 720 with mounted LEDs 722 and an electrical connector 724. The circuit board 720 is retained in a base 732 and is covered by a transparent or translucent cover 730. The electrical connector 724 extend from two joining ends 752 and are designed to electrically connect with the electrical connector 714 of the two straight LED lamp sections 702A and 702B in the same manner as described with other embodiments of the invention. The joiner pieces 706 can comprise a hollow section of plastic tube with walls 740 and a channel 742 formed therein which is preferably slightly larger than an outer diameter of both the straight tubular LED lamp sections 702A and 702B and the ends of the U-shaped lamp section 704. While not shown, additional joiner units such as described with reference to FIGS. 7-11 can be used, or the U-shaped lamp section 704 can incorporated tubular extensions that have an internal diameter slightly larger than the outer diameter of the ends of the straight tubular LED lamp sections 702A and 702B, for example similar as shown in FIG. 24.

The preferred embodiments of this invention have been disclosed, however, so that one of ordinary skill in the art would recognize that certain modifications would come within the scope of this invention. It is pointed out that while two elongate LED lamp sections are shown attached together either end-to-end or together with a U-shaped unit, more than two units could be used to form LED linear lamp assemblages, and such intermediate units would basically be as described with respect to the U-shaped lamp section in FIG. 24 that is straight instead of being bent in a U-shaped configuration.

What is claimed is:

1. A LED linear lamp assemblage comprising:

at least two LED linear lamp sections, each LED linear lamp section comprising an elongated tube with a first end and a second end, a circuit board with a plurality of spaced apart LEDs, said circuit board being disposed within the tube, a connection at a first end of the at least two LED linear lamp sections for connecting to a power source, and an electrical connector on the at least two LED linear lamp sections; and a joiner unit for mechanically connecting the at least two LED linear lamps sections at their second ends;

wherein the at least two LED linear lamp sections are connected at their second ends to establish electrical connection with their electrical connectors to form the LED linear lamp assemblage; and wherein the joiner unit comprises an insert with spring loaded pins, the insert sized to engage with the at least two LED linear lamp sections at their second ends and retain the two LED linear lamp sections together, with the spring loaded pins being adapted to engage with pin catches on the LED linear lamp sections.

2. The LED linear lamp assemblage of claim 1, wherein the elongate tube comprises a base portion to which is affixed the circuit board and a transparent or translucent cover that connects to the base portion above the LEDs on the circuit board and wherein the joiner unit comprises a section of resilient material that engages with an outside of the base portion.

3. The LED linear lamp of claim 1, wherein the elongate tube comprises a base portion to which is affixed the circuit board and a transparent or translucent cover that connects to the base portion above the LEDs on the circuit board.

4. A LED linear lamp assemblage comprising:

at least two LED linear lamp sections, each LED linear lamp section comprising an elongated tube with a first end and a second end, a circuit board with a plurality of spaced apart LEDs, said circuit board being disposed within the tube, a connection at a first end of the at least two LED linear lamp sections for connecting to a power source, and an electrical connector on the at least two LED linear lamp sections, and wherein the elongate tube comprises a base portion to which is affixed the circuit board and a transparent or translucent cover that connects to the base portion above the LEDs on the circuit board, and wherein the at least two LED linear lamp sections are connected at their second ends to establish electrical connection with their electrical connectors; and a joiner unit for mechanically connecting the at least two LED linear lamp sections at their second ends that comprises a tubular extension of the transparent or translucent cover of one of the at least two LED linear lamp sections that extends beyond the second end of that LED linear lamp section, which tubular extension has an internal diameter that is slightly larger than an outer diameter of the another of the tube of the LED linear lamp section.

5. A LED linear lamp assemblage comprising:

at least two LED linear lamp sections, each LED linear lamp section comprising an elongated tube with a first end and a second end, a circuit board with a plurality of spaced apart LEDs, said circuit board being disposed within the tube, a connection at a first end of the at least two LED linear lamp sections for connecting to a power source, and an electrical connector on the at least two LED linear lamp sections; and a clear joining ring that is sized to slide over the elongate tubes of the two LED linear lamp sections, wherein the clear joining ring has an extension extending from a circular sleeve, the extension having a magnet fixed thereon, and wherein the at least two LED linear lamp sections are connected at their second ends to establish electrical connection with their electrical connectors to form the LED linear lamp assemblage.

6. A LED linear lamp assemblage comprising:

at least two LED linear lamp sections, each LED linear lamp section comprising an elongated tube with a first end and a second end, a circuit board with a plurality of spaced apart LEDs, said circuit board being disposed within the tube, a connection at a first end of the at least two LED linear lamp sections for connecting to a power source, and an electrical connector on the at least two LED linear lamp sections, wherein in the at least two LED linear lamp sections the LEDs and electrical connectors are located on a top of the circuit board; and wherein the at least two LED linear lamp sections are connected at their second ends to establish electrical connection with their electrical connectors to form the LED linear lamp assemblage.

7. A LED linear lamp assemblage comprising:

at least two LED linear lamp sections, each LED linear lamp section comprising an elongated tube with a first end and a second end, a circuit board with a plurality of spaced apart LEDs, said circuit board being disposed within the tube, a connection at a first end of the at least two LED linear lamp sections for connecting to a power source, and an electrical connector on the at least two LED linear lamp sections, wherein in the at least two LED linear lamp sections the LEDs are located on a top of the circuit board and the electrical connectors are located on a bottom of the circuit board; and wherein the at least two LED linear lamp sections are connected at their second ends to establish electrical connection with their electrical connectors to form the LED linear lamp assemblage.

8. A LED linear lamp assemblage comprising:

at least two LED linear lamp sections, each LED linear lamp section comprising an elongated tube with a transparent or translucent cover that connects to a base portion that defines a space inside, a circuit board with a plurality of spaced apart LEDs, said circuit board being disposed within the space of the tube, a connection at a first end of the at least two LED linear lamp sections for connecting to a power source, and an electrical connector on at a second end of the at least two LED linear lamp sections; and a joiner unit for mechanically connecting the at least two LED linear lamps sections at their second ends, wherein the joiner unit comprises an insert with spring loaded pins, the insert sized to engage with the at least two LED linear lamp sections at their second ends and retain the two LED linear lamp sections together, with the spring loaded pins being adapted to engage with pin catches on the LED linear lamp sections, and wherein the at least two LED linear lamp sections are connected at their second ends to establish electrical connection with their electrical connectors to form the LED linear lamp assemblage.

9. The LED linear lamp assemblage of claim 8, wherein the electrical connectors are located at the second ends of the at least two LED linear lamp sections and make electrical contact with each other when the at least two LED linear lamp sections are brought together.

10. The LED linear lamp assemblage of claim 8, further comprising an electrical harness for electrically connecting the electrical connectors on the at least two LED linear lamp sections.

11. A LED linear lamp assemblage comprising:

at least two LED linear lamp sections, each LED linear lamp section comprising an elongated tube with a transparent or translucent cover that connects to a base portion that defines a space inside, a circuit board with a plurality of spaced apart LEDs, said circuit board being disposed within the space of the tube, a connection at a first end of the at least two LED linear lamp sections for connecting to a power source, and an electrical connector on at a second end of the at least two LED linear lamp sections; and a joiner unit for mechanically connecting the at least two LED linear lamps sections at their second ends, wherein the at least two LED linear lamp sections are connected at their second ends to establish electrical connection with their electrical connectors to form the LED linear lamp assemblage; and a clear joining ring that is sized to slide over the elongate tubes of the two LED linear lamp sections, the joining ring having an extension extending from a circular sleeve, the extension having a magnet fixed thereon.

12. A U-shaped LED linear lamp assemblage comprising:

two LED linear lamp sections, each with a first end and a second end, each LED linear lamp section comprising an elongated tube, a circuit board with a plurality of spaced apart LEDs, said circuit board being disposed within the tube, a connection at the first end of the at least two LED linear lamp sections for connecting to a power source, and an electrical connector on the at least two LED linear lamp sections; and a U-shaped lamp section having a circuit board with associated LEDs, which U-shaped lamp section has complementary electrical connectors at two ends;

wherein the two LED linear lamp sections are connected at their second ends to the two ends of the U-shaped lamp section to establish electrical connection and form the U-shaped LED linear lamp assemblage.

13. The U-shaped LED linear lamp assemblage of claim 12, wherein the two LED linear lamp sections and the U-shaped lamp section each comprise a base portion to which is affixed its corresponding circuit board, and a transparent or translucent cover that connects to the base portion above the LEDs on the corresponding circuit boards.

14. The U-shaped LED linear lamp assemblage of claim 12, further comprising joiner units for mechanically connecting the two LED linear lamps sections at their second ends to the U-shaped lamp section.

* * * * *